US010553190B2

(12) United States Patent
Ogawa

(10) Patent No.: US 10,553,190 B2
(45) Date of Patent: Feb. 4, 2020

(54) KEYBOARD APPARATUS

(71) Applicant: YAMAHA CORPORATION, Hamamatsu-shi (JP)

(72) Inventor: Kento Ogawa, Funabashi (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/251,374

(22) Filed: Jan. 18, 2019

(65) Prior Publication Data

US 2019/0156803 A1 May 23, 2019

Related U.S. Application Data

(63) Continuation of application No. PCT/JP2017/024723, filed on Jul. 5, 2017.

(30) Foreign Application Priority Data

Jul. 22, 2016 (JP) ..... 2016-144490

(51) Int. Cl.
*G10C 5/10* (2019.01)
*G10H 1/34* (2006.01)
*G10C 3/12* (2006.01)

(52) U.S. Cl.
CPC ..... *G10H 1/346* (2013.01); *G10C 3/12* (2013.01); *G10C 5/10* (2019.01)

(58) Field of Classification Search
CPC . G10H 1/346; G10H 1/34; G10C 5/10; G10C 3/12; G10B 3/12
See application file for complete search history.

(56) References Cited

U.S. PATENT DOCUMENTS 8,383,920 B2 * 2/2013 Komatsu ..... G10C 3/20 84/17
8,445,765 B2 5/2013 Sawada et al.

FOREIGN PATENT DOCUMENTS

JP H0511746 A 1/1993
JP 2012145728 A 8/2012
JP 2013167790 A 8/2013

OTHER PUBLICATIONS

International Search Report issued in Intl. Appln No. PCT/JP2017/024723 dated Sep. 19, 2017 English translation provided.

(Continued)

*Primary Examiner* — Kimberly R Lockett
(74) *Attorney, Agent, or Firm* — Rossi, Kimms & McDowell LLP

(57) ABSTRACT

A keyboard apparatus includes: a key; a hammer assembly; a first member having a step; a second member slidable relative to the first member and configured to be moved in a direction in which the second member moves over the step, when the key is pressed; and a third member configured to guide the second member such that the second member is not located at a distance greater than or equal to a predetermined distance from the first member. The third member has a shape at a region of the third member such that the third member does not contact the second member in a state in which the second member is in contact with the first member. When the second member moves over the step, the region is opposed to the second member in the direction in which the second member moves over the step.

16 Claims, 9 Drawing Sheets

(56) References Cited

OTHER PUBLICATIONS

Written Opinion issued in Intl. Appln PCT/JP2017/024723 dated Sep. 19 2017 English translation provided.
English Translation of International Preliminary Report on Patentability issued in Intl. Appln. No. PCT/JP2017/024723 dated Jan. 31, 2019.

* cited by examiner

KEYBOARD APPARATUS

CROSS REFERENCE TO RELATED APPLICATION

The present application is a continuation application of International Application No. PCT/JP2017/024723, filed on Jul. 5, 2017, which claims priority to Japanese Patent Application No. 2016-144490, filed on Jul. 22, 2016. The contents of these applications are incorporated herein by in their entirety.

BACKGROUND

The present disclosure relates to a keyboard apparatus.

In acoustic pianos, an operation of an action mechanism gives a predetermined feel (hereinafter referred to as "touch feel") to a finger of a player through a key. In particular, an operation of an escapement mechanism gives a collision feel and then gives a falling feel (hereinafter referred to as "click feel" as a whole, for example) as the touch feel to the finger of the player in accordance with the speed of key pressing. Acoustic pianos require an action mechanism for striking a string with a hammer. In electronic keyboard instruments, a sensor detects key pressing, enabling generation of a sound without such an action mechanism provided in the acoustic pianos. A touch feel of an electronic keyboard instrument not using any action mechanism and a touch feel of an electronic keyboard instrument using a simple action mechanism are greatly different from the touch feel of the acoustic piano. To solve this problem, various methods have been discussed in order for electronic keyboard instruments to achieve a touch feel close to that of acoustic pianos as disclosed in Patent Document 1 (Japanese Patent Application Publication No. 2013-167790).

SUMMARY

In electronic keyboard instruments, it is important to reproduce a collision feel and a falling feel in order to obtain a touch feel (especially a click feel) close to that of acoustic pianos.

An object of the present disclosure is to bring a click feel generated by key pressing on an electronic keyboard instrument, closer to that of acoustic pianos.

Means for Solving Problem

In one aspect of the present disclosure, a keyboard apparatus includes: a key disposed so as to be pivotable with respect to a frame; a hammer assembly disposed so as to be pivotable in response to a pivotal movement of the key; a first member including a step on a surface of the first member; a second member disposed so as to be slid relative to the first member when the hammer assembly pivots in response to the pivotal movement of the key, the second member being configured to be moved in a direction in which the second member moves over the step, when the key is pressed; and a third member connected to the first member, the third member having a shape at a region of the third member such that the region of the third member does not contact the second member in a state in which the second member is in contact with the first member, the region of the third member being, when the second member moves over the step, opposed to the second member in the direction in which the second member moves over the step.

In another aspect of the present disclosure, a keyboard apparatus includes: a key disposed so as to be pivotable with respect to a frame; a hammer assembly disposed so as to be pivotable in response to a pivotal movement of the key; a first member including a step on a surface of the first member; a second member disposed so as to be slid relative to the first member when the hammer assembly pivots in response to the pivotal movement of the key, the second member being configured to be moved in a direction in which the second member moves over the step, when the key is pressed; and a third member connected to the first member, wherein a surface of the third member includes a recess at a position opposed to the step.

In yet another aspect of the present disclosure, a keyboard apparatus includes: a key disposed so as to be pivotable with respect to a frame; a hammer assembly disposed so as to be pivotable in response to a pivotal movement of the key; a first member including a step on a surface of the first member; a second member disposed so as to be slid relative to the first member when the hammer assembly pivots in response to the pivotal movement of the key, the second member being configured to be moved in a direction in which the second member moves over the step, when the key is pressed; and a third member connected to the first member, the third member having a weak-restitution region configured to apply a force pressing the second member back that is weaker than a force pressing the second member back applied by other regions of the third member outside the weak-restitution region of the third member in response to the same force applied by the second member.

In yet another aspect of the present disclosure, a keyboard apparatus includes: a key disposed so as to be pivotable with respect to a frame; a hammer assembly disposed so as to be pivotable in response to a pivotal movement of the key; a first member comprising a step on a surface of the first member; a second member disposed so as to be slid relative to the first member when the hammer assembly pivots in response to the pivotal movement of the key, the second member being configured to be moved in a direction in which the second member moves over the step, when the key is pressed; and a third member connected to the first member, the third member having a shape at a region of the third member such that the region of the third member does not contact the second member in a state in which the second member is in contact with the first member, the region of the third member being located downstream of the step in the direction in which the second member moves over the step when the key is pressed.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENTS

Figure 1:
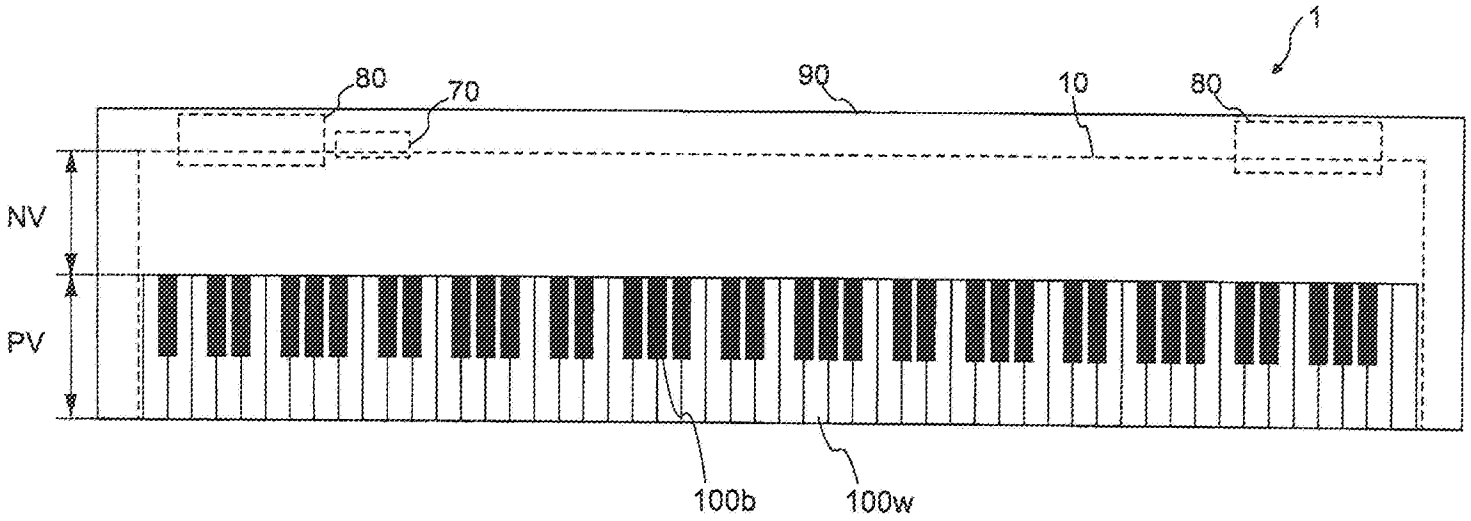
FIG. 1 is a view of a keyboard apparatus according to a first embodiment.

Hereinafter, there will be described embodiments by reference to the drawings. It is to be understood that the following embodiments are described only by way of example, and the disclosure may be otherwise embodied with various modifications without departing from the scope and spirit of the disclosure. It is noted that the same or similar reference numerals (e.g., numbers with a character, such as A or B, appended thereto) may be used for components having the same or similar function in the following description and drawings, and an explanation of which is dispensed with. The ratio of dimensions in the drawings (e.g., the ratio between the components and the ratio in the lengthwise, widthwise, and height directions) may differ from the actual ratio, and portions of components may be omitted from the drawings for easier understanding purposes.

First Embodiment

Configuration of Keyboard Apparatus

FIG. 1 is a view of a keyboard apparatus according to a first embodiment. In the present embodiment, a keyboard apparatus 1 is an electronic keyboard instrument, such as an electronic piano, configured to produce a sound when a key is pressed by a user (a player). It is noted that the keyboard apparatus 1 may be a keyboard-type controller configured to output data (e.g., MIDI) for controlling an external sound source device, in response to key pressing. In this case, the keyboard apparatus 1 may include no sound source device.

The keyboard apparatus 1 includes a keyboard assembly 10. The keyboard assembly 10 includes white keys 100*w* and black keys 100*b* arranged side by side. The number of the keys 100 is N. In the present embodiment, N is 88. A direction in which the keys 100 are arranged will be referred to as "scale direction". The white key 100*w* and the black key 100*b* may be hereinafter collectively referred to "the key 100" in the case where there is no need of distinction between the white key 100*w* and the black key 100*b*. Also in the following explanation, "w" appended to the reference number indicates a configuration corresponding to the white key. Also, "b" appended to the reference number indicates a configuration corresponding to the black key.

A portion of the keyboard assembly 10 is located in a housing 90. In the case where the keyboard apparatus 1 is viewed from an upper side thereof, a portion of the keyboard assembly 10 which is covered with the housing 90 will be referred to as "non-visible portion NV", and a portion of the keyboard assembly 10 which is exposed from the housing 90 and viewable by the user will be referred to as "visible portion PV". That is, the visible portion PV is a portion of the key 100 which is operable by the user to play the keyboard apparatus 1. A portion of the key 100 which is exposed by the visible portion PV may be hereinafter referred to as "key main body portion".

The housing 90 contains a sound source device 70 and a speaker 80. The sound source device 70 is configured to create a sound waveform signal in response to pressing of the key 100. The speaker 80 is configured to output the sound waveform signal created by the sound source device 70, to an outside space. It is noted that the keyboard apparatus 1 may include: a slider for controlling a sound volume; a switch for changing a tone color; and a display configured to display various kinds of information.

In the following description, up, down, left, right, front, and back (rear) directions (sides) respectively indicate directions (sides) in the case where the keyboard apparatus 1 is viewed from the player during playing. Thus, it is possible to express that the non-visible portion NV is located on a back side of the visible portion PV, for example. Also, directions and sides may be represented with reference to the key 100. For example, a key-front-end side (a key-front side) and a key-back-end side (a key-back side) may be used. In this case, the key-front-end side is a front side of the key 100 when viewed from the player. The key-back-end side is a back side of the key 100 when viewed from the player. According to this definition, it is possible to express that a portion of the black key 100*b* from a front end to a rear end of the key main body portion of the black key 100*b* is located on an upper side of the white key 100*w*.

Figure 2:
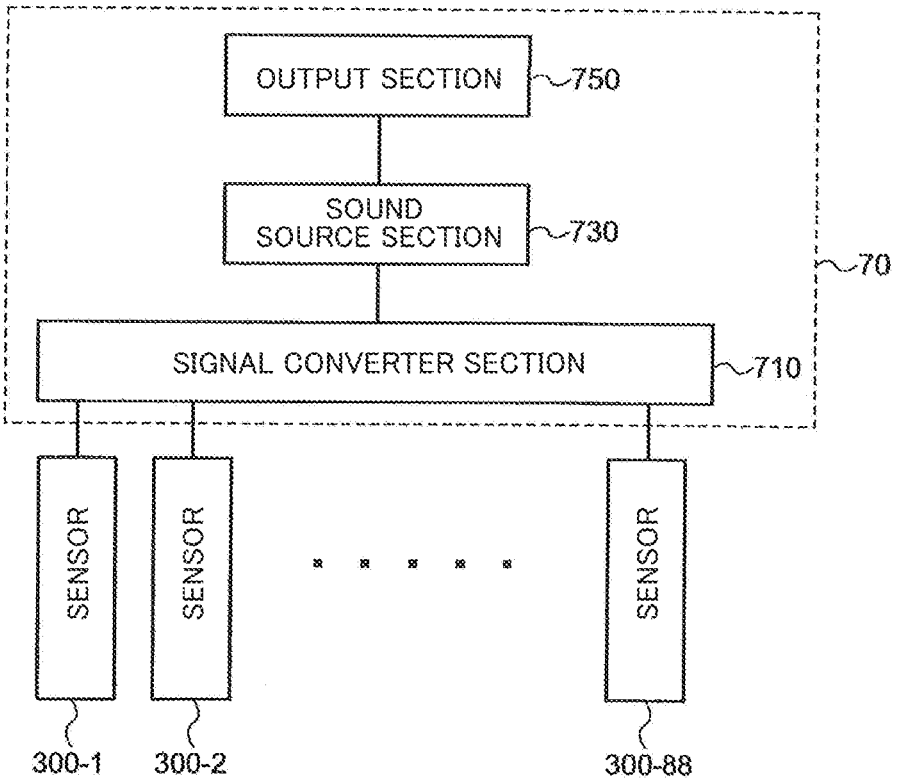
FIG. 2 is a block diagram illustrating a configuration of a sound source device in the first embodiment.

FIG. 2 is a block diagram illustrating the configuration of the sound source device in the first embodiment. The sound source device 70 includes a signal converter section 710, a sound source section 730, and an output section 750. Sensors 300 are provided corresponding to the respective keys 100. Each of the sensors 300 detects an operation of a corresponding one of the keys 100 and outputs signals in accordance with the detection. In the present example, each of the sensors 300 outputs signals in accordance with three levels of key pressing amounts. The speed of the key pressing is detectable in accordance with a time interval between the signals.

The signal converter section 710 obtains the signals output from the sensors 300 (the sensors 300-1, 300-2, . . . , 300-88 corresponding to the respective 88 keys 100) and creates and outputs an operation signal in accordance with an operation state of each of the keys 100. In the present example, the operation signal is a MIDI signal. Thus, the signal converter section 710 outputs "Note-On" when a key is pressed. In this output, a key number indicating which one of the 88 keys 100 is operated, and a velocity corresponding to the speed of the key pressing are also output in association with "Note-On". When the player has released the key 100, the signal converter section 710 outputs the key number and "Note-Off" in association with each other. A signal created in response to another operation, such as an operation on a pedal, may be output to the signal converter section 710 and reflected on the operation signal.

The sound source section 730 creates the sound waveform signal based on the operation signal output from the signal converter section 710. The output section 750 outputs the sound waveform signal created by the sound source section 730. This sound waveform signal is output to the speaker 80 or a sound-waveform-signal output terminal, for example.

Configuration of Keyboard Assembly

Figure 3:
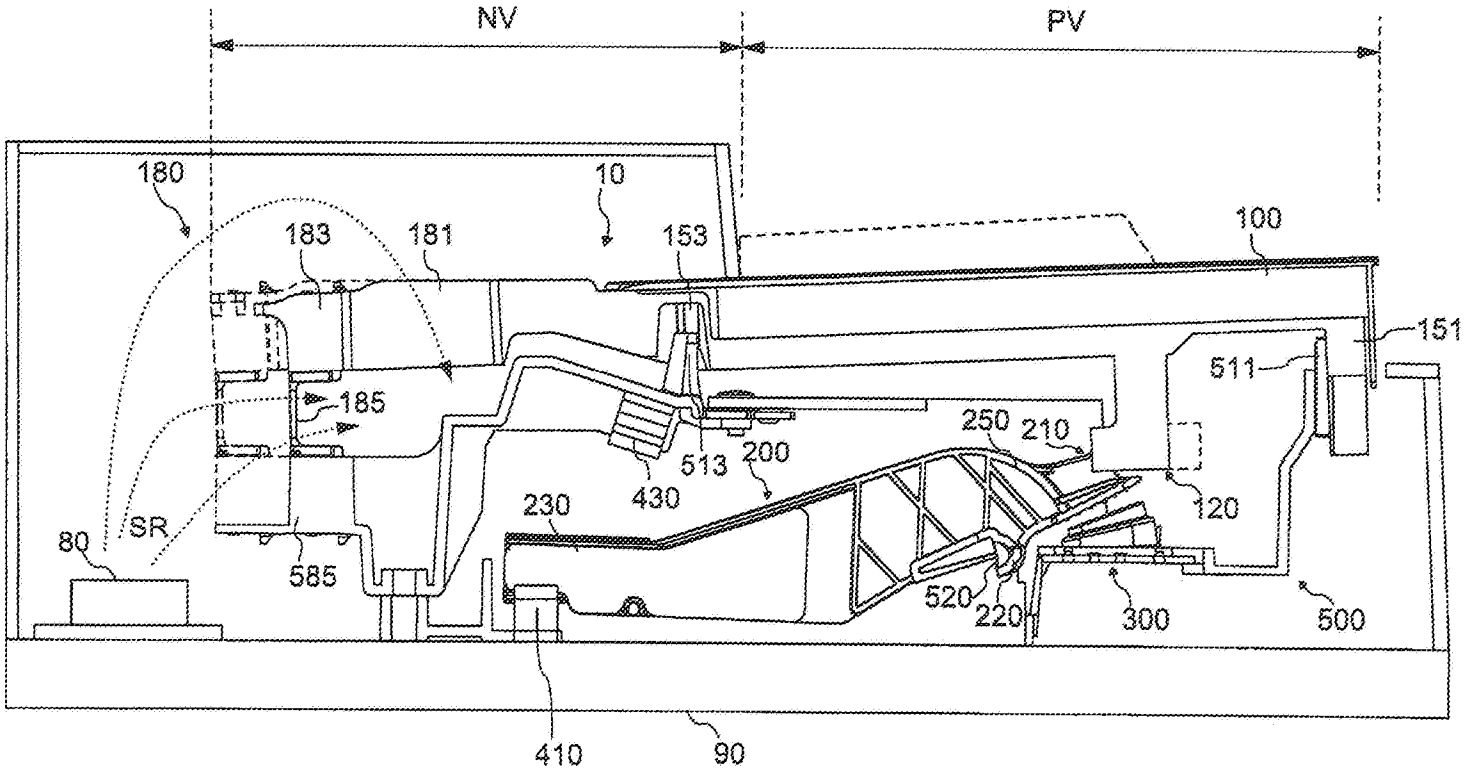
FIG. 3 is a view of a configuration of the inside of a housing in the first embodiment, with the configuration viewed from a lateral side of the housing.

FIG. 3 is a view of a configuration of the inside of the housing in the first embodiment, with the configuration viewed from a lateral side of the housing. As illustrated in FIG. 3, the keyboard assembly 10 and the speaker 80 are disposed in the housing 90. That is, the housing 90 covers at least a portion of the keyboard assembly 10 (a connecting portion 180 and a frame 500) and the speaker 80. The speaker 80 is disposed at a back portion of the keyboard assembly 10. This speaker 80 is disposed so as to output a sound, which is produced in response to pressing of the key 100, toward up and down sides of the housing 90. The sound output downward travels toward the outside from a portion of the housing 90 near its lower surface. The sound output upward passes from the inside of the housing 90 through a space in the keyboard assembly 10 and travels to the outside from a space between the housing 90 and the keys 100 or from spaces each located between adjacent two of the keys 100 at the visible portion PV. It is noted that paths SR are one example of paths of sounds output from the speaker 80 to a space formed in the keyboard assembly 10, i.e., a space under the keys 100 (the key main body portions).

There will be next described a configuration of the keyboard assembly 10 with reference to FIG. 3. In addition to the keys 100, the keyboard assembly 10 includes the connecting portion 180, a hammer assembly 200, and the frame 500. The keyboard assembly 10 is formed of resin, and a most portion of the keyboard assembly 10 is manufactured by, e.g., injection molding. The frame 500 is fixed to the housing 90. The connecting portion 180 connects the keys 100 to the frame 500 such that the keys 100 are pivotable. The connecting portion 180 includes plate-like flexible members 181, key-side supporters 183, and rod-like flexible members 185. Each of the plate-like flexible members 181 extends from a rear end of a corresponding one of the keys 100. Each of the key-side supporters 183 extends from a rear end of a corresponding one of the plate-like flexible members 181. Each of the rod-like flexible members 185 is supported by a corresponding one of the key-side supporters 183 and a frame-side supporter 585 of the frame 500. That is, each of the rod-like flexible members 185 is disposed between a corresponding one of the keys 100 and the frame 500. When the rod-like flexible member 185 is bent, the key 100 pivots with respect to the frame 500. The rod-like flexible member 185 is detachably attached to the key-side supporter 183 and the frame-side supporter 585. It is noted that the rod-like flexible member 185 may be integral with the key-side supporter 183 and the frame-side supporter 585 or bonded so as not to be attached or detached.

The key 100 includes a front-end key guide 151 and a side-surface key guide 153. The front-end key guide 151 is in slidable contact with a front-end frame guide 511 of the frame 500 in a state in which the front-end key guide 151 covers the front-end frame guide 511. The front-end key guide 151 is in contact with the front-end frame guide 511 at opposite side portions of upper and lower portions of the front-end key guide 151 in the scale direction. The side-surface key guide 153 is in slidable contact with a side-surface frame guide 513 at opposite side portions of the side-surface key guide 153 in the scale direction. In the present embodiment, the side-surface key guide 153 is disposed at portions of side surfaces of the key 100 which correspond to the non-visible portion NV, and the side-surface key guide 153 is nearer to the front end of the key 100 than the connecting portion 180 (the plate-like flexible member 181), but the side-surface key guide 153 may be disposed at a region corresponding to the visible portion PV.

A key-side load portion 120 is connected to the key 100 at a lower part of the visible portion PV. When the key 100 pivots, the key-side load portion 120 is connected to the hammer assembly 200 so as to cause pivotal movement of the hammer assembly 200.

The hammer assembly 200 is disposed at a space under the key 100 and attached so as to be pivotable with respect to the frame 500. The hammer assembly 200 includes a weight 230 and a hammer body 250. A shaft supporter 220 is disposed on the hammer body 250. The shaft supporter 220 serves as a bearing for a pivot shaft 520 of the frame 500. The shaft supporter 220 and the pivot shaft 520 of the frame 500 are held in sliding contact with each other in at least three positions.

A hammer-side load portion 210 is connected to a front end portion of the hammer body 250. The hammer-side load portion 210 has a portion in the key-side load portion 120, which portion is held in contact with the key-side load portion 120 so as to be slidable generally in the front and rear direction. The portion of the hammer-side load portion 210 is a moving member 211, which will be described below (see FIG. 4). Lubricant such as grease may be provided on this contacting portion. The hammer-side load portion 210 and the key-side load portion 120 are slid on each other to generate a portion of load when the key 100 is pressed. The hammer-side load portion 210 and the key-side load portion 120 may be hereinafter referred collectively as "load generator". The load generator in this example is located under the key 100 at the visible portion PV (in front of a rear end of the key main body portion). The configuration of the load generator will be described later in detail.

The weight 230 has a metal weight and is connected to the rear end portion of the hammer body 250 (which is located on a back side of a pivot shaft of the hammer assembly 200). In a normal state (i.e., a state in which the key 100 is not pressed), the weight 230 is placed on a lower stopper 410, resulting in the key 100 stably kept at a rest position. When the key 100 is pressed, the weight 230 moves upward and collides against an upper stopper 430. This defines an end position corresponding to the maximum pressing amount of the key 100. This weight 230 also imposes load on pressing of the key 100. The lower stopper 410 and the upper stopper 430 are formed of a cushioning material such as a nonwoven fabric and a resilient material, for example.

Below the load generator, the sensors 300 are mounted on the frame 500. When the sensor 300 is pressed and deformed under a lower surface of the hammer-side load portion 210 in response to pressing of the key 100, the sensor 300 outputs a detection signal. As described above, the sensors 300 correspond respectively to the keys 100.

Configuration of Load Generator

Figure 4:
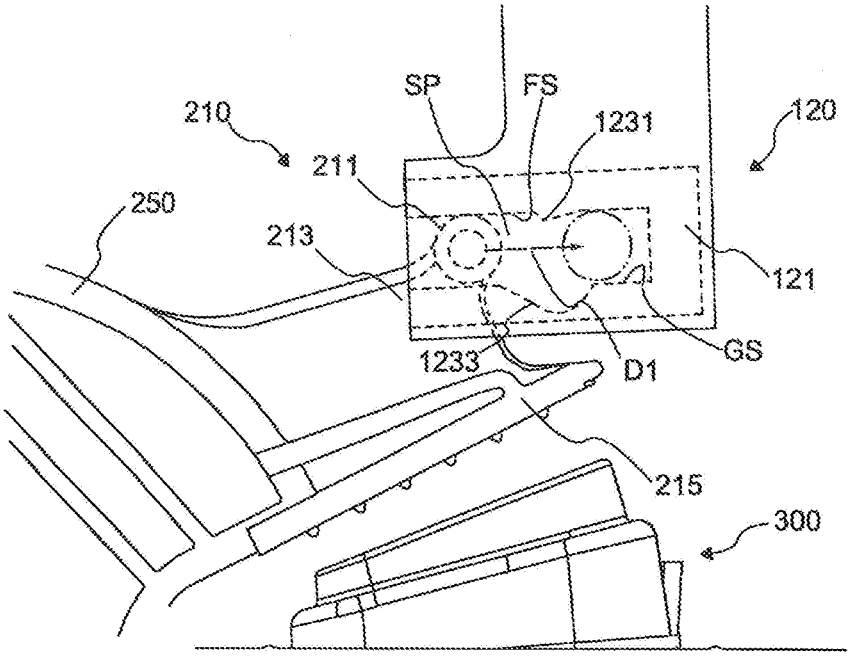
FIG. 4 is a view for explaining a load generator (a key-side load portion and a hammer-side load portion) in the first embodiment.

FIG. 4 is a view for explaining the load generator (the key-side load portion and the hammer-side load portion) in the first embodiment. The hammer-side load portion 210 includes the moving member 211 (as one example of a second member), a rib 213, and a sensor driving member 215 as a plate member. These components are also connected to the hammer body 250. The moving member 211 has a substantially circular cylindrical shape in this example, and the axis of the moving member 211 extends in the scale direction. The rib 213 is connected to a lower portion of the moving member 211. In this example, the direction of the normal to a surface of the rib 213 extends along the scale direction. The sensor driving member 215 is a plate member connected to a lower portion of the rib 213. The direction of the normal to a surface of the sensor driving member 215 is perpendicular to the scale direction. That is, the sensor driving member 215 and the rib 213 are perpendicular to each other. Here, the surface of the rib 213 contains a direction in which the rib 213 is moved by pressing of the key 100. This increases the respective strengths of the moving member 211 and the sensor driving member 215 in a direction in which the moving member 211 and the sensor driving member 215 are moved when the key 100 is pressed. Here, the rib 213 and the sensor driving member 215 serve as a reinforcement for the moving member 211. The moving member 211 and the rib 213 serve as a reinforcement for the sensor driving member 215. With this configuration, the components are reinforced with each other and made strong as a whole when compared with a configuration in which the rib is merely provided. It is noted that, as illustrated in FIG. 4, the moving member 211 is connected to the front end portion of the hammer body 250 via the rib 213. As described above, the weight 230 is connected to the rear end portion of the hammer body 250 (which is located on a back side of the pivot shaft of the hammer assembly 200). That is, the moving member 211 is located on an opposite side of the pivot shaft of the hammer assembly 200 from the weight 230. In other words, the moving member 211 is located on a front side of the pivot shaft of the hammer assembly 200, and the weight 230 is located on a rear side of the pivot shaft of the hammer assembly 200.

The key-side load portion 120 has a sliding-surface forming portion 121. As illustrated in FIG. 4, the sliding-surface forming portion 121 is disposed at a lower end portion of the key-side load portion 120 extending downward from the key 100. That is, the sliding-surface forming portion 121 is disposed on the key 100 at a position where the sliding-surface forming portion 121 is movable downward when the key 100 is pressed. The inside of the sliding-surface forming portion 121 has a space SP in which the moving member 211 is movable. A sliding surface FS is formed above the space SP, and a guide surface GS is formed below the space SP. A region in which at least the sliding surface FS is formed by an elastic member formed of rubber, for example. That is, this elastic member is exposed. In this example, the entire sliding-surface forming portion 121 is formed by the elastic member. This elastic member preferably has viscoelasticity. That is, the elastic member preferably is a viscoelastic member. Since the sliding-surface forming portion 121 is an elastic member, the sliding-surface forming portion 121 is surrounded by a stiff member formed of a material not easily deformed, such as resin having stiffness that is higher than that of the elastic member constituting the sliding-surface forming portion 121. With this configuration, the sliding-surface forming portion 121 is supported so as to maintain the shape of an outer surface of the sliding-surface forming portion 121. This outer surface contains a surface of the sliding-surface forming portion 121 which is opposed to the sliding surface FS. It is noted that the stiffness of the sliding-surface forming portion 121 may gradually increase in its portion extending from the sliding surface FS to the stiff member located outside the outer surface of the sliding-surface forming portion 121. This portion preferably does not contain a component that is elastically deformed more easily than the sliding surface FS, e.g., a component having lower stiffness than the sliding surface FS.

The position of the moving member 211 in FIG. 4 indicates a position when the key 100 is located at the rest position. When the key 100 is pressed, the moving member 211 moves the space SP in the direction indicated by arrow D1 (hereinafter may be referred to as "traveling direction D1") while contacting the sliding surface FS. That is, the moving member 211 is slid relative to the sliding surface FS. Since the moving member 211 moves while contacting the sliding surface FS, the sliding surface FS and the moving member 211 may be hereinafter referred to as "intermittent sliding side" and "continuous sliding side", respectively. Since the moving member 211 is also slightly rotated, and its contact surface is moved, the moving member 211 is not continuously slid strictly, but substantially continuously slid. In any case, the area of the entire portion of the sliding surface FS which is contactable by the moving member 211 in a region in which the sliding surface FS and the moving member 211 are slid in response to pressing of the key 100 is greater than that of the entire portion of the moving member 211 which is contactable by the sliding surface FS.

In response to pressing of the key 100, the entire load generator is moved downward, so that the sensor driving member 215 presses and deforms the sensor 300. In this example, a step 1231 formed in a portion of the sliding surface FS in which the moving member 211 is moved by pivotal movement of the key 100 from the rest position to the end position. That is, the moving member 211 moved from an initial position moves over the step 1231. This initial position is a position the moving member 211 when the key 100 is located at the rest position. A recess 1233 is formed in a portion of the guide surface GS which is opposed to the step 1231. The recess 1233 prevents the moving member 211 from contacting the guide surface GS until the moving member 211 moves over the step 1231, thereby avoiding interference to movement of the moving member 211. The configuration of the sliding-surface forming portion 121 will be described below in detail.

Configuration of Sliding-Surface Forming Portion

Figure 5C:
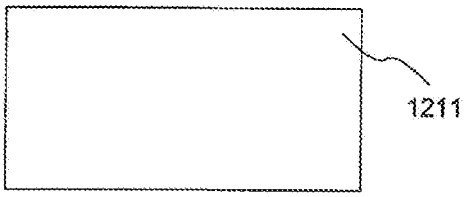
FIGS. 5A through 5E are views for explaining a configuration of a sliding-surface forming portion in the first embodiment.
Figure 5B:
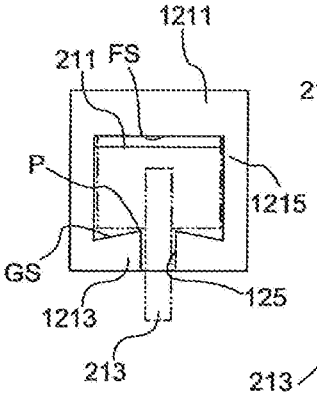
Figure 5A:
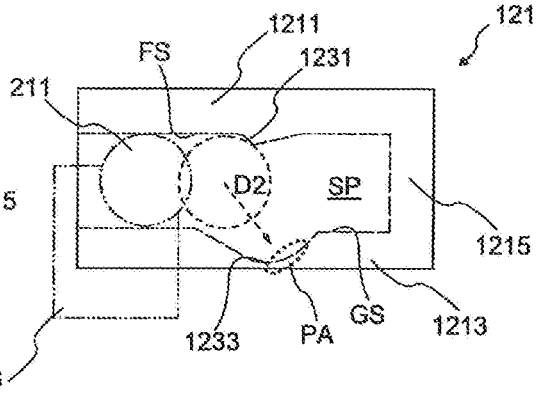
Figure 5E:
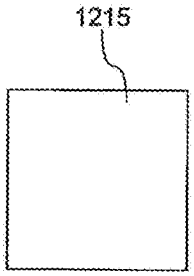
Figure 5D:
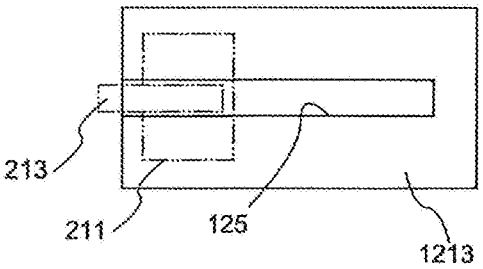

FIGS. 5A through 5E are views for explaining the configuration of the sliding-surface forming portion 121 in the first embodiment. FIG. 5A is a view for specifically explaining the sliding-surface forming portion 121 explained above with reference to FIG. 4, and the broken line in FIG. 5A indicates a configuration in the sliding-surface forming portion 121. FIG. 5B is a view of the sliding-surface forming portion 121 viewed from a rear side thereof (from the key-back-end side). FIG. 5C is a view of the sliding-surface forming portion 121 viewed from an upper side thereof. FIG. 5D is a view of the sliding-surface forming portion 121 viewed from a lower side thereof. FIG. 5E is a view of the sliding-surface forming portion 121 viewed from a front side thereof (from the key-front-end side). It is noted that a region in which the moving member 211 and the rib 213 are located is indicated by the two-dot chain line.

The sliding-surface forming portion 121 includes an upper member 1211 (as one example of a first member), a lower member 1213 (as one example of a third member), and a side member 1215. The upper member 1211 and the lower member 1213 are connected to each other by the side member 1215. The space SP is surrounded by the upper member 1211, the lower member 1213, and the side member 1215. A surface of the upper member 1211 near the space SP is the sliding surface FS. The step 1231 is formed on the sliding surface FS as described above. A surface of the upper member 1211 near the space SP is the guide surface GS. The guide surface GS guides the moving member 211 so as to prevent the moving member 211 from being located at a distance greater than or equal to a predetermined distance, from the upper member 1211 (the sliding surface FS). That is, as illustrated in FIG. 4, the upper member 1211 is disposed under the key 100, and the lower member 1213 is disposed under the upper member 1211. The lower member 1213 is disposed such that the moving member 211 is interposed between the lower member 1213 and the upper member 1211.

The recess 1233 is formed in the guide surface GS as described above. According to the shape of the recess 1233 in this example, the moving member 211 and the guide surface GS are not in contact with each other in a state in which the moving member 211 is in contact with the sliding surface FS, in a region PA opposed to the moving member 211 in a moving direction D2 in which the moving member 211 is moved over the step 1231, when the moving member 211 is moved over the step 1231 by key pressing. That is, the recess 1233 has the region PA as illustrated in FIG. 5A and has a space located in front of the step in the traveling direction D1 of the moving member 211. Since the moving member 211 is moved to the space located in front of the step 1231, the moving member 211 does not contact the guide surface GS until the moving member 211 is moved over the step 1231. If the moving member 211 collides against the guide surface GS immediately after the moving member 211 is moved over the step 1231, a falling feel is obtained momentarily, following a collision feel on the step 1231, but a collision feel is generated again by collision of the moving member 211 against the guide surface GS. In contrast, in the configuration in which collision of the moving member 211 against the guide surface GS is avoided for a certain length of time after the moving member 211 is moved over the step 1231, and even if the moving member 211 collides against the guide surface GS, a falling feel is obtained for the certain length of time from a collision feel generated due to the step 1231, it is possible to obtain a click feel close to that of acoustic pianos. It is noted that, since the moving direction D2 has a frontward component as illustrated in FIG. 5A, the region PA disposed in the moving direction D2 of the moving member 211 is located on a front side of the step 1231 in the traveling direction D1 of the moving member 211. That is, the region PA is located on a back side of the step 1231 in the traveling direction D1 of the moving member 211.

The lower member 1213 has a slit 125. The rib 213 moved with the moving member 211 passes through the slit 125. Though not illustrated in FIGS. 5A-5E, as illustrated in FIG. 4, the sensor driving member 215 is connected to the rib 213 at a position located on an opposite side of the rib 213 from the moving member 211. This configuration establishes a positional relationship in which the lower member 1213 is interposed between the moving member 211 and the sensor driving member 215.

The guide surface GS of the lower member 1213 is inclined so as to be nearer to the sliding surface FS at a portion of the guide surface GS near the slit 125 than at a portion of the guide surface GS far from the slit 125. That is, the lower member 1213 has portions each protruding along the slit 125 in a line shape (hereinafter may be referred to as "protruding portions P"). Thus, the area of contact between the moving member 211 and the sliding surface FS is less than that of contact between the moving member 211 and the guide surface GS. In this example, the moving member 211 is separated from the guide surface GS when the moving member 211 is in contact with the sliding surface FS, and the moving member 211 is separated from the sliding surface FS when the moving member 211 is in contact with the guide surface GS. It is noted that the moving member 211 may be slid while contacting both of the sliding surface FS and the guide surface GS, in at least a portion of a region in which the moving member 211 is movable. Also in this case, the recess 1233 has a region in which the moving member 211 contacts only one of the sliding surface FS and the guide surface GS (a region at least partly overlapping the region PA).

When the key 100 is pressed, a force is applied from the sliding surface FS to the moving member 211. The force transmitted to the moving member 211 causes pivotal movement of the hammer assembly 200 so as to move the weight 230 upward. In this operation, the moving member 211 is pressed downward against the sliding surface FS by the sliding-surface forming portion 121 and moved in the traveling direction D1 with respect to the sliding surface FS. When the key 100 is released, the weight 230 falls downward, which causes pivotal movement of the hammer assembly 200, so that an upward force is applied from the moving member 211 to the sliding surface FS. Here, the moving member 211 is formed of a material less easily deformed than that of the elastic member forming the sliding surface FS, such as resin having higher stiffness than the elastic member forming the sliding surface FS. Thus, when the moving member 211 is pressed against the sliding surface FS, the sliding surface FS is elastically deformed. As a result, movement of the moving member 211 receives various resisting forces in accordance with a force by which the moving member 211 is pressed. These resisting forces will be described with reference to FIGS. 6 and 7.

Figure 6:
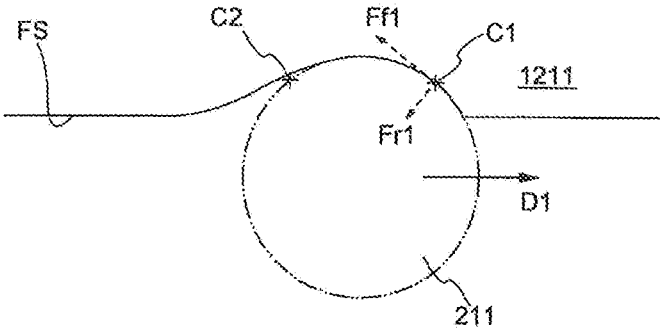
FIG. 6 is a view for explaining elastic deformation of an elastic member in the first embodiment (when a key is strongly struck)
Figure 7:
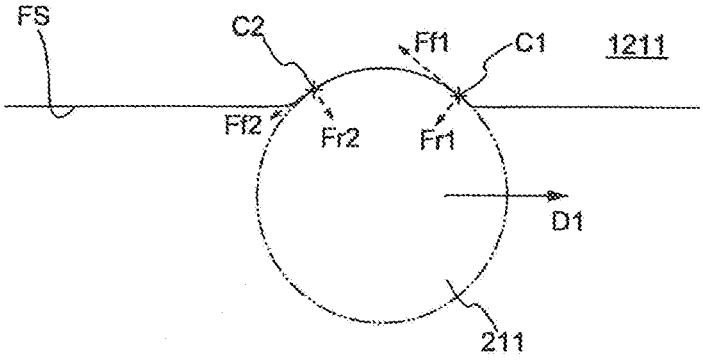
FIG. 7 is a view for explaining elastic deformation of the elastic member in the first embodiment (when a key is weakly struck)

FIG. 6 is a view for explaining elastic deformation of the elastic member in the first embodiment when the key 100 is strongly struck. FIG. 7 is a view for explaining elastic deformation of the elastic member in the first embodiment when the key 100 is weakly struck. When the key 100 is pressed, the moving member 211 is moved in the traveling direction D1. In this movement, since the moving member 211 is pressed against the sliding surface FS of the upper member 1211, the upper member 1211 formed of an elastic material is deformed by its elastic deformation such that the sliding surface FS is recessed.

At the point C1 located on a traveling-direction-D1-side portion of a surface of the moving member 211 (hereinafter may be referred to as "front portion of the moving member 211"), not only a frictional force Ff1 that is a force of friction with the upper member 1211 but also a reactive force Fr1 that is a force by which the moving member 211 is pressed back by the upper member 1211 acts as a resisting force against movement of the moving member 211 in the traveling direction D1. At the point C2 located on a portion of the surface of the moving member 211 which portion is located on an opposite side of the center of the moving member 211 from the traveling-direction-D1-side portion (hereinafter may be referred to as "rear portion of the moving member 211"), the moving member 211 contacts the upper member 1211 when the key 100 is weakly pressed or struck, but the moving member 211 does not contact the upper member 1211 when the key 100 is strongly pressed or struck (see FIG. 6).

The upper member 1211 is elastically deformed by the moving member 211. After the moving member 211 passes through the upper member 1211, the shape of the upper member 1211 is restored to its original shape. When the key 100 is strongly struck, the moving member 211 is moved earlier than the restoration. Thus, a region in which the moving member 211 and the upper member 1211 are not in contact with each other increases in the rear portion of the moving member 211. The region in which the moving member 211 and the upper member 1211 are not in contact with each other increases with increase in viscosity of the upper member 1211 even in the case of the same speed of movement of the moving member 211.

It is noted that a difference between weak strike and strong strike, i.e., a difference in force of pressing of the key 100 affects the degree of elastic deformation. A difference between weak strike and strong strike in the size of the region in which the moving member 211 and the upper member 1211 are not in contact with each other is caused directly by the speed of movement of the moving member 211, specifically. That is, in the case where the speed of key pressing has already increased even if a force of the key pressing is weak, the region in which the moving member 211 and the upper member 1211 are not in contact with each other increases. For example, in the case where the player presses the key 100 while bringing his or her hands down, a force acting on the key 100 is large at the start of the key pressing but decreases immediately, and thereby an amount of elastic deformation decreases, so that the moving member 211 moves at a substantially uniform speed. Since the speed of movement of the moving member 211 is still high, it is difficult for the upper member 1211 to receive a force from the rear portion of the moving member 211 by the effect of the viscosity of the upper member 1211, and the upper member 1211 is greatly affected by the reactive force Fr1 applied from the front portion of the moving member 211, which produces a resisting force against the key pressing.

In the case where the rear portion of the moving member 211 contacts the upper member 1211, the moving member 211 receives not only a frictional force Ff2 but also a reactive force Fr2. The frictional force Ff2 is a resisting force against the traveling direction D1. The reactive force Fr2 is a thrust force for the traveling direction D1. Also, an amount of elastic deformation of the upper member 1211 decreases with decrease in strength of key striking. Thus, the magnitude of the reactive force Fr1 is small, and the area of contact between the moving member 211 and the upper member 1211 is small as a whole, so that the magnitude of the frictional force also decreases. Thus, not only the frictional force but also effects caused by the reactive force are different between the situations in FIGS. 6 and 7. With these configurations, the strength and speed of key pressing enable complicated changes of the resisting force to be received by the moving member 211 in the traveling direction D1. The resisting force received by the moving member 211 also serves as a resisting force to be applied to key pressing. This reproduces changes of the resisting force applied to key pressing in accordance with the strength and speed of key pressing in an acoustic piano. It is also possible to achieve various designs of the resisting force applied to key pressing, by forming the upper member 1211 with a material in which elasticity greatly affected by acceleration (a force of key pressing) and viscosity greatly affected by speed (the speed of key pressing) are adjusted.

It is noted that, when the key 100 has reached the end position, the moving member 211 in some cases bounds to the sliding surface FS and collides against the guide surface GS, depending upon the strength of key pressing. In this case, the protruding portions P of the guide surface GS may be elastically deformed so as to be pressed and deformed by the moving member 211. Due to the presence of the protruding portions P, the area of contact between the moving member 211 and the guide surface GS is less than that of contact between the moving member 211 and the sliding surface FS. Thus, the guide surface GS is elastically deformed more easily than the sliding surface FS even in the case where a force of the same magnitude is applied. Accordingly, even in the case where the moving member 211 collides against the guide surface GS, a smaller collision sound is produced than in the case where the moving member 211 collides against the sliding surface FS.

Operations of Keyboard Assembly

Figure 8A:
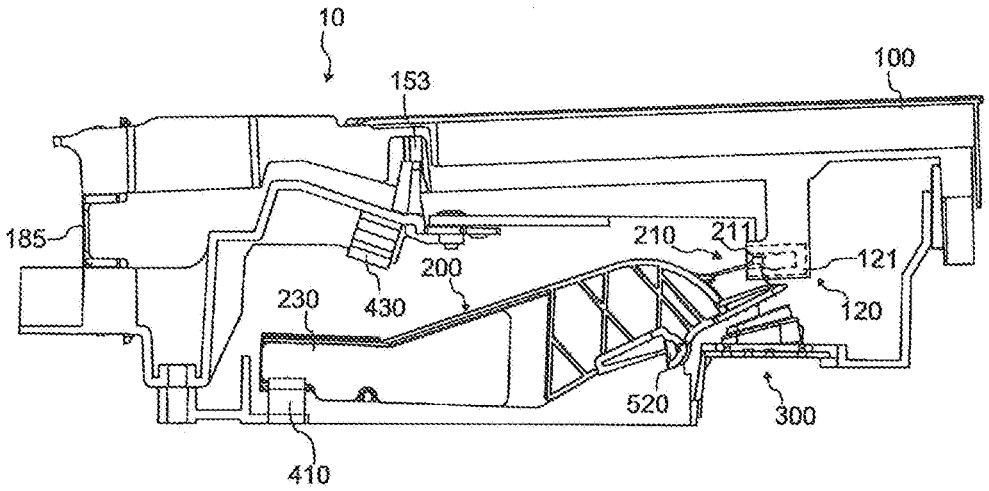
FIGS. 8A and 8B are views for explaining operations of a keyboard assembly when a key (a white key) is depressed in the first embodiment.
Figure 8B:
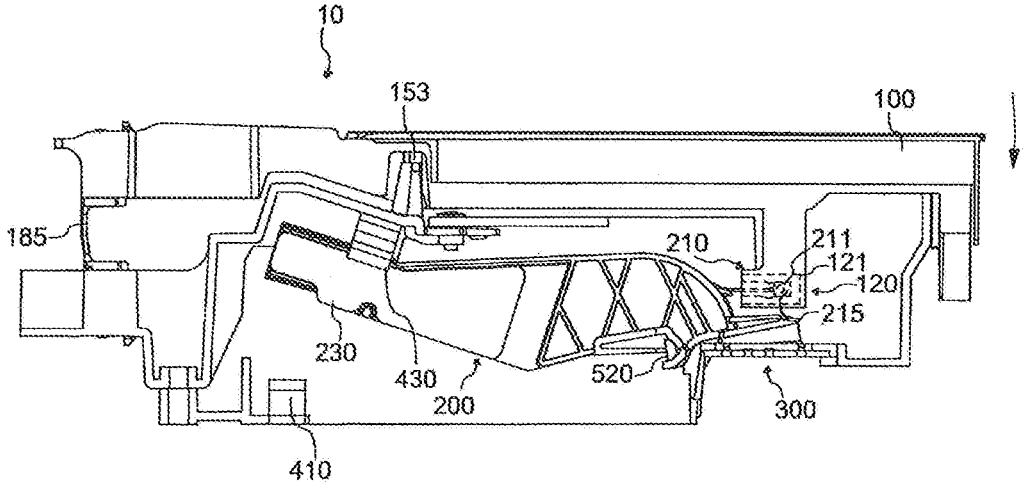

FIGS. 8A and 8B are views for explaining operations of the keyboard assembly when the key (the white key) is depressed in the first embodiment. FIG. 8A illustrates a state in which the key 100 is located at the rest position (that is, the key 100 is not depressed). FIG. 8B illustrates a state in which the key 100 is located at the end position (that is, the key 100 is fully depressed). When the key 100 is pressed, the rod-like flexible member 185 is bent as a pivot center. In this movement, the rod-like flexible member 185 is bent toward a front side of the key 100 (in the front direction), but movement of the rod-like flexible member 185 in the front and rear direction is limited by the side-surface key guide 153, whereby the key 100 does not move frontward but pivots in a pitch direction. The key-side load portion 120 depresses the hammer-side load portion 210, causing pivotal movement of the hammer assembly 200 about the pivot shaft 520. In the explanation for FIGS. 8A and 8B, FIGS. 4-5E are referred for the configuration of the sliding-surface forming portion 121 of the key-side load portion 120.

In the pivotal movement of the hammer assembly 200, the weight 230 is moved upward. Thus, the weight of the weight 230 applies a force to the key 100 so as to move the key 100 toward the rest position (upward). In the load generator (the key-side load portion 120 and the hammer-side load portion 210), the moving member 211 elastically deforms the upper member 1211 during movement in contact with the sliding surface FS, whereby the moving member 211 receives various resisting forces in accordance with a method of key pressing. The resisting forces and the weight of the weight 230 appear as load on key pressing. Also, the moving member 211 moves over the step 1231, whereby a click feel is transferred to the key 100. In this operation, collision of the moving member 211 against the guide surface GS immediately after the moving member 211 moves over the step 1231 is avoided, whereby a falling feel is obtained for a certain length of time, resulting in obtainment of a click feel close to that of acoustic pianos.

When the weight 230 collides against the upper stopper 430, the pivotal movement of the hammer assembly 200 is stopped, and the key 100 reaches the end position. When the sensor 300 is deformed by the sensor driving member 215, the sensor 300 outputs the detection signals in accordance with a plurality of levels of an amount of deformation of the sensor 300 (i.e., the key pressing amount).

When the key 100 is released, the weight 230 moves downward, causing pivotal movement of the hammer assembly 200. With the pivotal movement of the hammer assembly 200, the key 100 pivots upward via the load generator. When the weight 230 comes into contact with the lower stopper 410, the pivotal movement of the hammer assembly 200 is stopped, and the key 100 is returned to the rest position. In this movement, the moving member 211 is returned to the initial position.

Second Embodiment

A sliding-surface forming portion in a second embodiment includes a lower member 1213A having an opening in addition to the slit 125. In this example, the opening is formed in a region substantially opposed to the step 1231.

Figure 9:
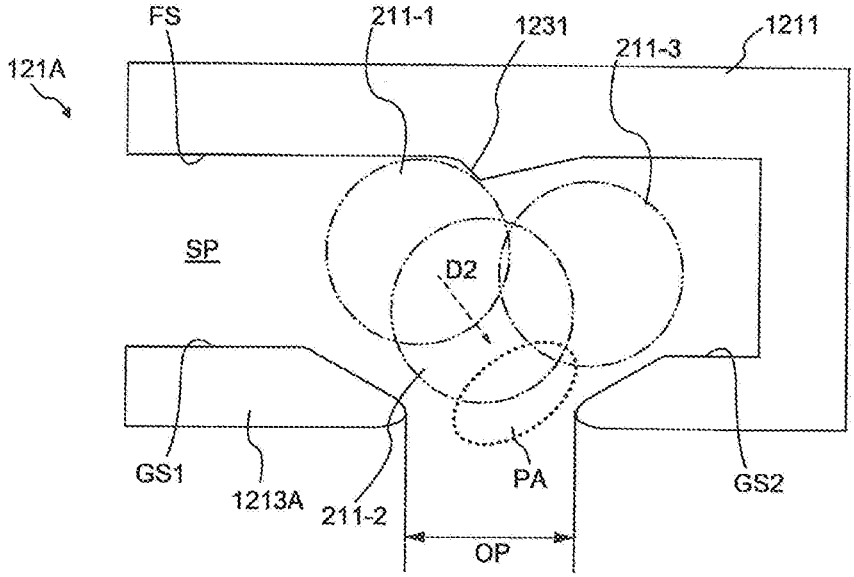
FIG. 9 is a view for explaining a sliding-surface forming portion in a second embodiment.

FIG. 9 is a view for explaining the sliding-surface forming portion in the second embodiment. FIG. 9 illustrates an inner shape of a sliding-surface forming portion 121A in the case where the space SP is viewed in the scale direction (the same case as in FIG. 5A). It is noted that the moving member 211 (indicated as 211-1, 211-2, 211-3 so as to correspond to changes in position in response to key pressing) is indicated by the two-dot chain lines.

The sliding-surface forming portion 121A has an opening OP formed in the lower member 1213A. The opening OP is formed so as to increase in size in the scale direction (the widthwise direction of the slit 125) such that the width of the opening OP becomes greater than that of the slit 125. Thus, the opening OP and the slit 125 are orthogonal to each other. The opening OP is formed so as to contain at least a portion of the region PA. As described above, the region PA is a region opposed to the moving member 211 in the moving direction D2 when the moving member 211 is moved over the step 1231 in response to key pressing. It is noted that the opening OP may be formed in the entirety or a portion of the lower member 1213A in the scale direction. In the case where the opening OP is formed in a portion of the lower member 1213A, the length of the opening OP is preferably greater than the length of the moving member 211 in the scale direction, but the present disclosure is not limited to this configuration. In the example in FIG. 9, the shape of an end portion of the opening OP has a curved shape but may be formed only by a flat shape. A stiff member surrounding the sliding-surface forming portion 121A may or may not have an opening in a portion corresponding to the opening OP.

As illustrated in FIG. 9, the moving member 211-1 is in a state in which the moving member 211 has reached the step 1231. The moving member 211-2 is in a state in which the moving member 211 has been moved from the state of the moving member 211-1 to a state of the moving member 211 in which the moving member 211 has been moved in the moving direction D2 to move over the step 1231. The moving member 211-3 is in a state in which the moving member 211 has been further moved from the state of the moving member 211-2 and passed over the step 1231. Since the opening OP is formed at the region PA, the moving member 211 in this state is not in contact with the guide surface GS until the moving member 211 moves over the step 1231. In FIG. 9, a guide surface GS1 is a portion of the guide surface GS which is nearer to the initial position than the opening OP, and a guide surface GS2 is a portion of the guide surface GS which is far from the initial position than the opening OP.

Also in this configuration, as in the first embodiment, when the moving member 211 moves over the step 1231, the moving member 211 does not contact or collide against the guide surface GS, making it possible to obtain a click feel close to that of acoustic pianos.

Third Embodiment

A sliding-surface forming portion in a third embodiment includes a lower member 1213B having a weak-restitution region corresponding to the recess 1233 in the first embodiment.

Figure 10:
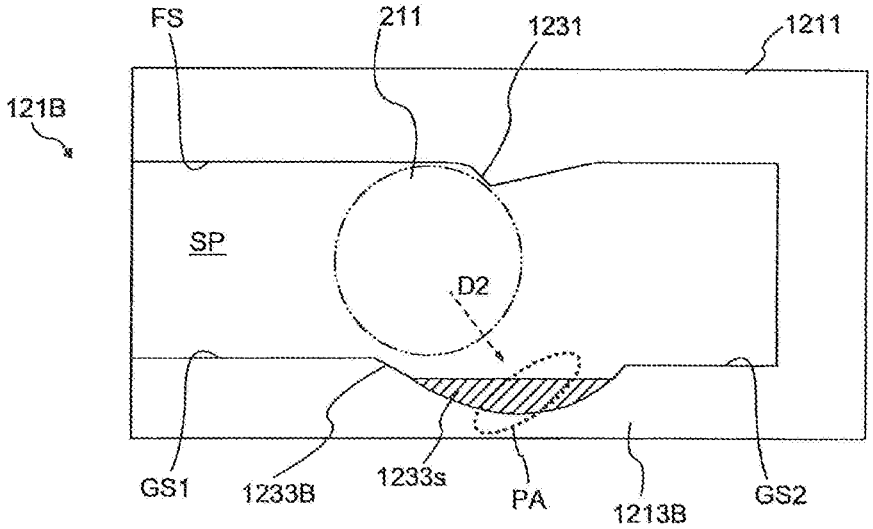
FIG. 10 is a view for explaining a weak-restitution region in a third embodiment.
Figure 11:
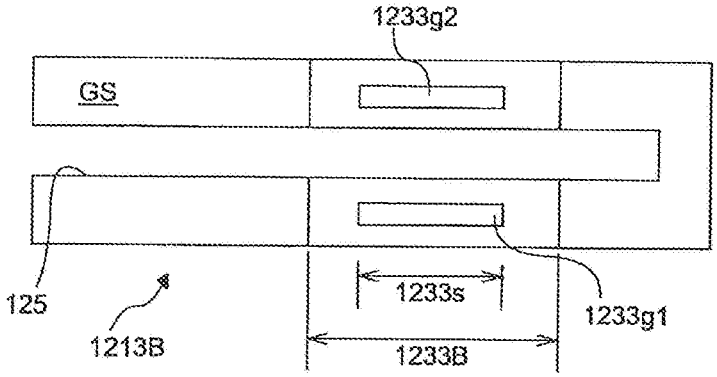
FIG. 11 is a view of the weak-restitution region in the third embodiment when the weak-restitution region is viewed from a moving-member side.

FIG. 10 is a view for explaining the weak-restitution region in the third embodiment. FIG. 11 is a view of the weak-restitution region in the third embodiment when the weak-restitution region is viewed from a moving-member side. In FIG. 10, the two-dot chain line indicates the moving member 211 having reached the step 1231 (which corresponds to the position of the moving member 211-1 in FIG. 9 in the second embodiment). The lower member 1213B includes a recess 1233B that has a weak-restitution region 1233*s* that is elastically deformed more easily than an elastic member constituting the guide surface GS corresponding to the initial position and thus that has a weak restitution property. It is noted that the recess 1233B may not be formed in the lower member 1213B. Also in this case, the weak-restitution region 1233*s* only needs to be disposed so as to contain at least a portion of the region PA.

As illustrated in FIG. 11, the weak-restitution region 1233*s* has grooves 1233*g*1, 1233*g*2 formed in the guide surface GS (the recess 1233B). These grooves 1233*g*1, 1233*g*2 reduce the area of contact between the moving member 211 and the guide surface GS. With this configuration, a force applied from the moving member 211 is received by the reduced contact portion of the weak-restitution region 1233*s*. As a result, the weak-restitution region 1233*s* is elastically deformed more easily than the other regions even in the case where the same force is applied. In addition, the restitution property of the weak-restitution region 1233*s* is weak. It is noted that the weak-restitution region 1233*s* may be formed of a material having a restitution property (the coefficient of restitution) less than that of the regions other than the weak-restitution region 1233*s* or a material easily elastically deformed. In this case, the weak-restitution region 1233*s* may not have the grooves 1233*g*1, 1233*g*2.

With the configuration in which the weak-restitution region 1233*s* is provided, even in the case where the moving member 211 contacts or collides against the guide surface GS when moving over the step 1231, the guide surface GS is easily deformed and has a weak restitution property. As a result, a collision feel generated by collision against the guide surface GS is reduced, and thereby effects on the falling feel are small, making it possible to obtain a click feel close to that of acoustic pianos.

Fourth Embodiment

In a fourth embodiment, the key 100 and the key-side load portion 120 are indirectly connected to each other.

Figure 12A:
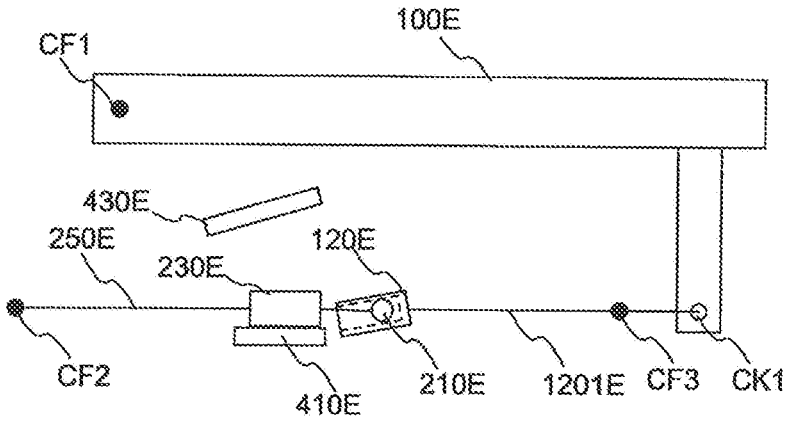
FIGS. 12A and 12B are views for schematically explaining a relationship in connection between a key and a hammer of a keyboard assembly in a fourth embodiment.
Figure 12B:
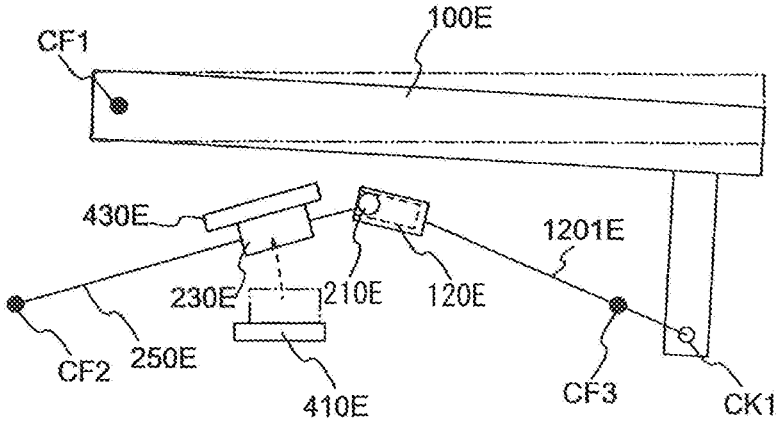

FIGS. 12A and 12B are views for schematically explaining a relationship in connection between the key and a hammer of the keyboard assembly in the fourth embodiment. FIGS. 12A and 12B schematically represent a relationship among the key, the weight, and the load generator. FIG. 12A is a view when a key 100E is located at the rest position before the key 100E is pressed. FIG. 12B is a view when the key 100E is located at the end position after the key 100E is pressed.

The key 100E pivots about the center CF1. The center CF1 corresponds to the rod-like flexible members 185 in the above-described embodiment, for example. A key-side load portion 120E and the key 100E are connected to each other by a structure 1201E. The structure 1201E pivots about the center CF3. One end of the structure 1201E is rotatably connected to the key 100E by a linkage mechanism CK1. The other end of the structure 1201E is connected to the key-side load portion 120E. A hammer body 250E pivots about the center CF2. The center CF2 corresponds to the pivot shaft 520 in the above-described embodiment. A weight 230E is disposed between the center CF2 and a hammer-side load portion 210E.

With this configuration, when the key 100E is pressed, the hammer-side load portion 210E moving in the key-side load portion 120E moves the weight 230E upward until the key-side load portion 120E collides against an upper stopper 430E. That is, the state of the key 100 and the key-side load portion 120 is changed from the state illustrated in FIG. 12A to the state illustrated in FIG. 12B. When the key 100 is released, the weight 230E is moved downward to press the key 100E upward until the weight 230E collides against a lower stopper 410E. That is, the state of the key 100 and the key-side load portion 120 is changed from the state illustrated in FIG. 12B to the state illustrated in FIG. 12A. Thus, as long as the load generator is provided in a path of transfer of a force from the key to the hammer assembly, at least one of the key and the hammer assembly may be directly or indirectly connected to the load generator, enabling various configurations.

Modifications

While the embodiments have been described above, the disclosure may be embodied with various changes and modifications.

While the sensor driving member 215 is connected to the moving member 211 via the rib 213 in the above-described embodiments, the rib 213 may be omitted. In this configuration, the moving member 211 and the sensor driving member 215 at least have to be connected to the hammer body 250. The slit 125 may not be formed in the lower member 1213 in this configuration.

While the entire sliding-surface forming portion 121 is formed of an elastic material in the above-described embodiments, the present disclosure is not limited to this configuration. For example, an elastic member may be disposed on the entire region in which the sliding surface FS is formed. Only the protruding portions formed on the guide surface GS may be formed of an elastic material. To obtain the resisting forces against key pressing described in the first embodiment, a region in which the moving member 211 is contactable with the sliding surface FS only needs to be formed of at least an elastic material in the entire range in which the key 100 is movable. It is noted that the entire sliding-surface forming portion 121 may be formed of a material other than the elastic material.

While the key-side load portion 120 containing the sliding surface FS is connected to the key 100, and the hammer-side load portion 210 containing the moving member 211 is connected to the hammer assembly 200 in the above-described embodiments, this relationship may be reversed. In the case where this relationship is reversed, specifically, the sliding surface FS is formed on the hammer-side load portion 210, and the key-side load portion 120 includes the moving member 211. That is, this keyboard apparatus 1 only needs to be configured such that one of the moving member 211 and the sliding surface FS is connected to the key 100, and the other is connected to the hammer assembly 200.

A portion of the region of the lower member 1213 (the guide surface GS) may be omitted as described in the second embodiment. More portion of the region or the entire region of the lower member 1213 (the guide surface GS) may be omitted. The guide surface GS is desirably left on a region in which the moving member 211 easily collides against the guide surface GS. For example, immediately after the key 100 is pressed to the end position, the hammer assembly 200 is kept rotated by an inertial force, whereby the moving member 211 is easily moved off the sliding surface FS. Immediately after the key 100 is returned to the rest position, when the hammer assembly 200 is kept rotated by an inertial force, the moving member 211 in some cases collides with and bounces off the sliding surface FS. In these situations, the moving member 211 easily contacts the guide surface GS. That is, the guide surface GS is preferably disposed at least at opposite end portions of the region in which the moving member 211 is movable.

While the protruding portions P are disposed on the lower member 1213 in the above-described embodiments, the protruding portions P may be omitted. In this configuration, the guide surface GS may be parallel with the sliding surface FS.

What is claimed is:

1. A keyboard apparatus, comprising:

a key disposed so as to be pivotable with respect to a frame;

a hammer assembly disposed so as to be pivotable in response to a pivotal movement of the key;

a first member including a step on a surface of the first member;

a second member disposed so as to be slid relative to the first member when the hammer assembly pivots in response to the pivotal movement of the key, the second member being configured to be moved in a direction in which the second member moves over the step, when the key is pressed; and a third member connected to the first member, the third member having a shape at a region of the third member such that the region of the third member does not contact the second member in a state in which the second member is in contact with the first member, the region of the third member being, when the second member moves over the step, opposed to the second member in the direction in which the second member moves over the step.

2. The keyboard apparatus according to claim 1, wherein the third member has a recessed shape at the region of the third member.

3. The keyboard apparatus according to claim 1, wherein the third member has an opening at the region of the third member.

4. The keyboard apparatus according to claim 1, wherein the region of the third member is located downstream of the step in the direction in which the second member moves over the step.

5. The keyboard apparatus according to claim 1, wherein the third member is configured to be slid relative to the second member when the hammer assembly pivots in response to the pivotal movement of the key.

6. The keyboard apparatus according to claim 1, wherein one of the first member and the second member is connected to the key, and the other of the first member and the second member is connected to the hammer assembly.

7. The keyboard apparatus according to claim 1, wherein the hammer assembly includes a weight, and wherein the first member is configured to, when the key is pressed, allow sliding of the second member on the first member and apply a force to the second member so as to move the weight upward.

8. The keyboard apparatus according to claim 7, wherein the first member is disposed so as to be moved downward when the key is pressed, and wherein the second member is connected to the hammer assembly on an opposite side of a pivot axis of the hammer assembly from the weight such that the weight is moved upward when the second member is pressed downward by the downward movement of the first member.

9. The keyboard apparatus according to claim 8, wherein the third member is configured to guide the second member such that the second member is not located at a distance greater than or equal to a predetermined distance from the first member, the third member being disposed such that the second member is interposed between the third member and the first member.

10. A keyboard apparatus, comprising:

a key disposed so as to be pivotable with respect to a frame;

a hammer assembly disposed so as to be pivotable in response to a pivotal movement of the key;

a first member including a step on a surface of the first member;

a second member disposed so as to be slid relative to the first member when the hammer assembly pivots in response to the pivotal movement of the key, the second member being configured to be moved in a direction in which the second member moves over the step, when the key is pressed; and a third member connected to the first member, wherein a surface of the third member includes a recess at a position opposed to the step.

11. The keyboard apparatus according to claim 10, wherein the recess in the surface of the third member is located downstream of a position of the step in a direction in which the second member moves over the step.

12. A keyboard apparatus, comprising:

a key disposed so as to be pivotable with respect to a frame;

a hammer assembly disposed so as to be pivotable in response to a pivotal movement of the key;

a first member including a step on a surface of the first member;

a second member disposed so as to be slid relative to the first member when the hammer assembly pivots in response to the pivotal movement of the key, the second member being configured to be moved in a direction in which the second member moves over the step, when the key is pressed; and a third member connected to the first member, the third member including a weak-restitution region configured to apply a force pressing the second member back that is weaker than a force pressing the second member back applied by other regions of the third member outside the weak-restitution region of the third member in response to the same force applied by the second member.

13. The keyboard apparatus according to claim 12, wherein the weak-restitution region of the third member is located downstream of a position of the step in a direction in which the second member moves over the step.

14. The keyboard apparatus according to claim 12, wherein a material forming the weak-restitution region of the third member is softer than a material forming the other regions of the third member outside the weak-restitution region of the third member.

15. The keyboard apparatus according to claim 12, wherein a surface of the weak-restitution region of the third member includes a groove such that an area of contact between the second member and the third member at the weak-restitution region of the third member is less than an area of contact between the second member and the third member at the other regions of the third member outside the weak-restitution region of the third member.

16. A keyboard apparatus, comprising:

a key disposed so as to be pivotable with respect to a frame;

a hammer assembly disposed so as to be pivotable in response to a pivotal movement of the key;

a first member including a step on a surface of the first member;

a second member disposed so as to be slid relative to the first member when the hammer assembly pivots in response to the pivotal movement of the key, the second member being configured to be moved in a direction in which the second member moves over the step, when the key is pressed; and a third member connected to the first member, the third member having a shape at a region of the third member such that the region of the third member does not contact the second member in a state in which the second member is in contact with the first member, the region of the third member being located downstream of the step in the direction in which the second member moves over the step when the key is pressed.

* * * * *